US005313258A

United States Patent [19]

Nishi

[11] Patent Number: 5,313,258

[45] Date of Patent: May 17, 1994

[54] IMAGE FORMING APPARATUS FOR PERFORMING A DOUBLE-SIDED COPYING OPERATION

[75] Inventor: Takayuki Nishi, Kanagawa, Japan

[73] Assignee: Kabushiki Kaisha Toshiba, Tokyo, Japan

[21] Appl. No.: 947,260

[22] Filed: Sep. 18, 1992

[30] Foreign Application Priority Data

Sep. 30, 1991 [JP] Japan ..... 3-250696

[51] Int. Cl.[5] ..... G03G 21/00

[52] U.S. Cl. ..... 355/314; 271/301; 355/308; 355/321; 355/322

[58] Field of Search ..... 355/308, 309, 313, 314, 355/319, 321, 322, 23, 24; 271/301

[56] References Cited

U.S. PATENT DOCUMENTS 4,437,756 3/1984 Kawakubo et al. ..... 35/23 X
4,641,954 2/1987 Miyata et al. ..... 355/23 X
4,845,528 7/1989 Aoki et al. ..... 355/210
4,970,555 11/1990 Obana ..... 355/316

FOREIGN PATENT DOCUMENTS 0057143 4/1983 Japan .

*Primary Examiner*—Matthew S. Smith
*Attorney, Agent, or Firm*—Banner, Birch, McKie & Beckett

[57] ABSTRACT

An image forming apparatus includes a control section for automatically ejecting recording medium temporarily stacked in a stacking portion of the apparatus to an output tray when a double-sided mode is cancelled or changed, thereby conveniently removing the recording medium stacked in the stacking portion.

27 Claims, 9 Drawing Sheets

IMAGE FORMING APPARATUS FOR PERFORMING A DOUBLE-SIDED COPYING OPERATION

BACKGROUND OF THE INVENTION

1. Field of the Invention

The present invention relates to an image forming apparatus, such as an electrophotographic copying machine, which can perform a double-sided copying operation, and more particularly to an image forming apparatus which conveniently removes recording medium from the image forming apparatus when a double-sided copying operation is cancelled.

2. Description of the Related Art

Recently, image forming devices such as electric copying machines which can perform a double-sided copying operation are generally known. For example, U.S. Pat. No. 4,970,555 discloses a copying machine which can perform a double-sided copying operation. This copying machine includes a double-sided copying unit for reconveying a paper sheet to an image transfer position to perform the double-sided copying operation. The double-sided copying unit includes a stacking portion for temporarily stacking paper sheets having an image formed on one side before completing the double-sided copying operation.

In conventional copying machines, for example, if the double-sided copying mode is changed or cancelled while paper sheets are stacked in the stacking portion of the double-sided copying unit, the paper sheets remain in the stacking portion of the double-sided copying machine. It is then a necessary inconvenience for a user to open a front cover, or perform a blank copying operation, to remove the paper sheets from the stacking portion.

In order to solve this problem, Japanese Patent Disclosure (Kokai) No. 58-57143 discloses a copying machine having an ejecting device for ejecting paper sheets stacked in the stacking portion and an output tray for receiving the paper sheets ejected by the ejecting device. It is not necessary in this copying machine to open a front cover or perform a blank copying operation to remove paper sheets from the stacking portion. However, the ejecting device and the output tray increases the size and cost of the copying machine when there is presently a need to reduce the size and costs of copying machines. Moreover, this prior art reference does not describe the operation for ejecting paper sheets from the stacking portion.

SUMMARY OF THE INVENTION

It is an object of the present invention to provide an image forming apparatus having a double-sided copying unit which can remove the paper sheets therefrom without opening a cover to remove the sheets or performing a blank copying operation.

It is another object of the present invention to provide an image forming apparatus having a device which automatically removes paper sheets stacked in a double-sided copying unit by simple construction and operation.

Accordingly, the foregoing objectives, as well as others, are achieved by the present invention which provides an image forming apparatus including a forming unit for forming an image on a recording medium having first and second sides, a setting portion for setting a double-sided mode of operation, wherein the double-sided mode of operation is capable of forming an image on the first and second sides of the recording medium, and a feeding unit for feeding the recording medium to the forming unit to form the image on the second side of the recording medium when the double-sided mode of operation is set by the setting portion. The feeding unit includes a stacking portion for temporarily stacking the recording medium. The image forming apparatus also includes an output tray for receiving the recording medium on which the image has been formed and a control section for automatically ejecting the recording medium temporarily stacked in the stacking portion to the output tray when the double-sided mode of operation set by the setting portion is cancelled or changed.

A further aspect of the present invention provides an image forming apparatus including a forming unit for forming an image on a recording medium having first and second sides, and a setting portion for setting an operational mode of the forming unit. Operational modes of the forming unit include a single-sided mode and a double-sided mode, wherein the single-sided mode is capable of forming an image only on the first side of the recording medium and the double-sided mode is capable of forming the image on the first and second sides of the recording medium. The image forming apparatus also includes a supply unit for holding a supply of the recording medium, a first feeding portion for feeding the recording medium from the supply unit to the forming unit to form an image on the first side of the recording medium, and a second feeding portion for feeding the recording medium to the forming unit to form an image on the second side of the recording medium when the double-sided mode is set by the setting portion. The second feeding portion includes a stacking portion for temporarily stacking the recording medium. The image forming apparatus further includes an output tray for receiving the recording medium on which an image is formed, a third feeding portion for feeding the recording medium on which an image is formed to the output tray and a control section for automatically ejecting the recording medium temporarily stacked in the stacking portion to the output tray through the second feeding portion and the third feeding portion when the mode is changed from the double-sided mode to the single-sided mode by the setting portion.

In accordance with another aspect of the present invention, the above-stated objects are achieved by providing a copying machine including a supporting portion for positioning an original document, a scanning unit for optically scanning an image on the original document on the supporting portion, a forming unit for forming an image corresponding to the image on the original document scanned by the scanning unit on a recording medium having first and second sides, a setting portion for setting a double-sided mode of operation, wherein the double-sided mode of operation is capable of forming the image on the first and second sides of the recording medium, and a feeding unit to form the image on the second side of the recording medium when the double-sided mode is set by the setting portion. The feeding unit has a stacking portion for temporarily stacking the recording medium. The copying machine also includes an output tray for receiving the recording medium on which the image is formed, a first control section for automatically ejecting the recording medium temporarily stacked in the stacking portion to the output tray when the double-sided mode set by the setting portion is cancelled or changed and a second control section for controlling the scanning unit and the forming unit not to form an image on the second side of the recording medium which is automatically ejected from the stacking portion.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings wherein.

DETAILED DESCRIPTION OF THE PREFERRED EMBODIMENTS

Figure 1:
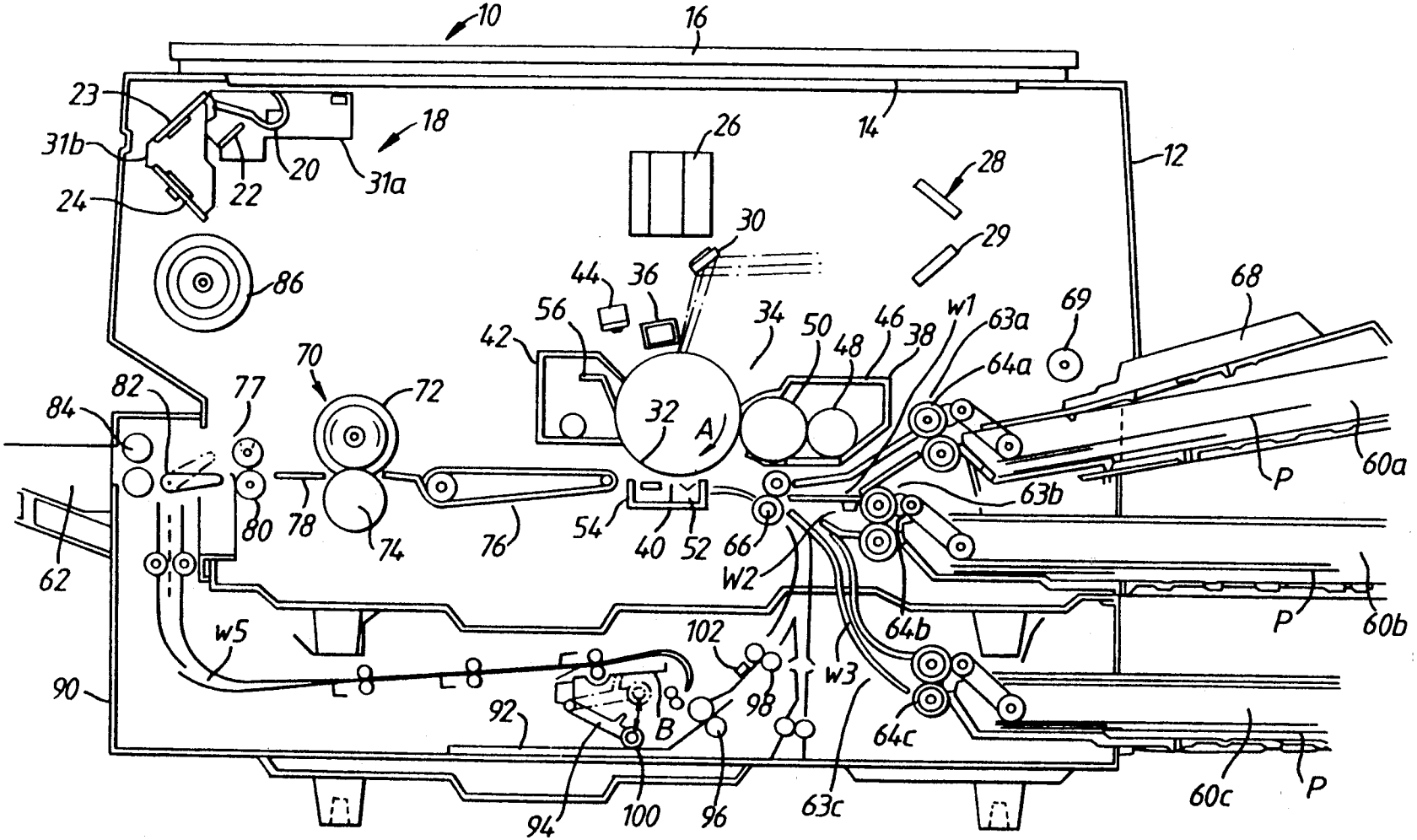
FIG. 1 is a sectional view of an image forming apparatus according to the present invention.

In the following detailed description, like reference numerals will be used to denote like elements in FIGS. 1 to 5.

FIG. 1 shows an image forming apparatus according to the present invention. The image forming apparatus may be one of a wide variety of image forming apparatus using image forming techniques which are known in the prior art, of course, the present invention is not so limited. For purposes of example, the image forming apparatus depicted is an electrophotographic copying machine 10.

Copying machine 10 includes housing 12, document table 14 and document cover 16 provided on the upper surface of housing 12. Document table 14 is formed of a transparent material such as glass. During use, document cover 16 is lifted away from document table 14 in order to place an original document on document table 14.

Copying machine 10 also includes scanning unit 18 for optically scanning an original document placed on document table 14. Scanning unit 18 includes an exposure lamp 20 for emitting light onto an original document placed on document table 14. Light emitted from exposure lamp 20 is reflected by the original document and is directed to an image bearing member, for example, photosensitive drum 32, through first, second and third reflecting mirrors 22, 23 and 24, variable magnification lens block 26 and fourth, fifth and sixth reflecting mirrors 28, 29 and 30. Exposure lamp 20 and first reflecting mirror 22 are mounted on first carriage 31*a*.

Exposure lamp 20 and first reflecting mirror 22 reciprocally move between both end portions of document table 14 in a lengthwise direction to scan an image on the original document. Second and third reflecting mirrors 23 and 24 are mounted on a second carriage 31*b*. Second carriage 31*b* moves through a distance which is half of the traveling distance of first carriage 31*a*. Variable magnification lens block 28 moves along an optical axis for providing image forming magnification.

Copying machine 10 includes an image forming unit 34 for forming an image on a recording medium, for example, paper sheet P, corresponding to the image scanned by scanning unit 18. Image forming unit 34 includes photosensitive drum 32 for forming a latent image in response to light on the surface thereof. Photosensitive drum 32 is disposed substantially in the center of housing 12 and is formed, for example, of an organic photoconductor (OPC). Photosensitive drum 32 is rotated by an electric motor (not shown) in the direction of arrow A.

Image forming unit 34 also includes a charging unit 36, a developing unit 38, an image transfer unit 40, a cleaning unit 42 and a discharging lamp 44 which respectively are arranged around the periphery of photosensitive drum 32 in the direction of its rotation. Charging unit 36 charges the entire surface of photosensitive drum 32 to a uniform level of charge in order to prepare the surface for forming a latent image. Developing unit 38 develops the latent image formed on photosensitive drum 32 with a toner in order to form a toner image. Developing unit 38 includes a container 46 which contains a two-element developer having a toner and a toner carrier. Container 46 includes a stirrer 48 for mixing the toner and the toner carrier together. Developing unit 38 also has a developing roller 50 for transporting the mixture of toner and toner carrier to a developing position or station facing the surface of the photosensitive drum 32.

Image transfer unit 40 transfers the toner image onto paper sheet P. Image transfer unit 40 includes first and second chargers 52 and 54. First charger 52 faces photosensitive drum 32 at an image transfer position and charges on paper sheet P to transfer the toner image formed on photosensitive drum 32 to paper sheet P. Second charger 54 charges paper sheet P to separate paper sheet P from photosensitive drum 32.

Cleaning unit 42 removes residual toner from photosensitive drum 32 after transfer of the toner image by image transfer unit 40. Cleaning unit 42 includes an elastic blade 56 which contacts the surface of photosensitive drum 32 to scrape the residual toner from the surface of photosensitive drum 32. Discharging lamp 44 radiates the surface of photosensitive drum 32 in order to set the electrical potential of the surface of the photosensitive drum 32 to a uniform level.

First, second and third paper supply cassettes 60*a*, 60*b* and 60*c* are inserted into a lower portion of housing 12. Cassettes 60*a*, 60*b* and 60*c* respectively hold a supply of paper sheets P. Third paper supply cassette 60*c* is removably attached to the right side portion of a double-sided copying unit 90 which will be described later. An output tray 62 is located on an outside portion of housing 12 to receive printed paper sheets P output from copying machine 10.

Copying machine 10 includes first, second and third feeding portions 63*a*, 63*b* and 63*c* for respectively feeding paper sheets P from first, second and third paper supply cassettes 60*a*, 60*b* and 60*c* to the image transfer portion. First feeding portion 63*a* includes first paper supply rollers 64*a* for picking up and supplying paper sheets P from first paper supply cassette 60*a*. First paper supply rollers 64*a* are provided at the top end of cassette 60*a* when cassette 60*a* is inserted into housing 12. Paper sheets P, when picked up from first paper supply cassette 60*a*, is then transported to the image transfer position through a first feeding path W1 and a pair of aligning rollers 66.

Second feeding portion 63*b* includes second paper supply rollers 64*b* for picking up and supplying paper sheets P from second paper supply cassette 60*b*. Second paper supply rollers 64*b* are provided at the top end of second paper supply cassette 60*b* when cassette 60*b* is inserted into housing 12. Paper sheets P, when supplied from cassette 60*b*, are then transported to the image transfer portion through a second feeding path W2 and aligning rollers 66.

Third feeding portion 63 includes third paper supply rollers 64*c* which are provided at the top end of third paper cassette 60*c* when cassette 60*c* is inserted into double-sided copying unit 90. Paper sheets P, when supplied from cassette 60*c*, are then transported to the image transfer position through a third feeding path W3 and aligning rollers 66.

A manual feeding tray 68 is arranged above first paper supply cassette 60*a*. Manual feeding tray 68 is used as a guide for manually feeding an individual paper sheet P. Paper supply roller 69 for supplying paper sheets P from manual feeding tray 68 is provided at the top end of tray 68. A paper sheet P, when supplied from manual feeding tray 68, is then transported to the image transfer position through a feeding path W1 and a pair of aligning rollers 66 similar to paper sheets P supplied from first paper supply cassette 60*a*.

A fixing unit 70 is located downstream of the image transfer position. Fixing unit 70 fixes the toner image onto paper a sheet P by heating and pressing paper sheet P with the toner image. Fixing unit 70 has a heating roller 72, a pressing roller 74 for pressing against heating roller 72, and a cleaner (not shown) for cleaning the surface of heating roller 72.

A paper transport portion 76 is located between the image transfer position and fixing unit 70. Paper sheet P from the image transfer position is transported to fixing unit 70 along paper transport portion 76.

An eject portion 77 is located downstream of fixing unit 70. Eject portion 77 ejects paper sheet P with the fixed toner image onto output tray 62 or directs paper sheet P to double-sided copying unit 90 which is provided below housing 12. Eject portion 77 includes guide 78, a first pair of eject rollers 80, gate 82 and a second pair of eject rollers 84. Gate 82 selects the eject position of paper sheet P with the fixed toner image. Both positions of gate 82 are shown, although in practice only one path is predetermined by controls. Thereby, paper sheet P is transported to either output tray 62 or double-sided copying unit 90, depending on the position of gate 82.

An exhaust fan 86 is located above eject portion 77 to prevent an excessive temperature rise inside housing 12.

As described above, copying apparatus 10 includes double-sided copying unit 90 for feeding paper sheets P to the image transfer position again when an image is transferred to the second side of paper sheets P. Paper sheets P are turned from a first side to a second side by double-sided copying unit 90, thereby, copying machine 10 can perform a double-sided copying operation on paper sheets P. Double-sided copying unit 90 includes a feeding path W5, stacking portion 92 for temporarily storing paper sheets P fed from feeding path W5. Double-sided copying unit 90 also includes a pair of pickup rollers 94 for picking up paper sheets P temporarily stacked in stacking portion 92. Pickup rollers 94 pick up paper sheets P stacked from the opposite direction than that in which they were initially stacked in stacking portion 92. Thereby, paper sheet P is turned from the first side to the second side when arriving at the image transfer position for transferring an image onto the second side of paper sheets P.

Double-sided copying unit 90 further includes a pair of supply rollers 96 and a pair of register rollers 98 for feeding paper sheets P picked up from stacking portion 92 to aligning rollers 66 to feed paper sheets P to the image transfer position.

Stacking portion 92 includes a first sensor 100 for detecting a supply of paper sheet P. Also, double-sided copying unit 90 includes a second sensor 102, located near register rollers 98, for detecting a supply of paper sheets P.

Figure 2:
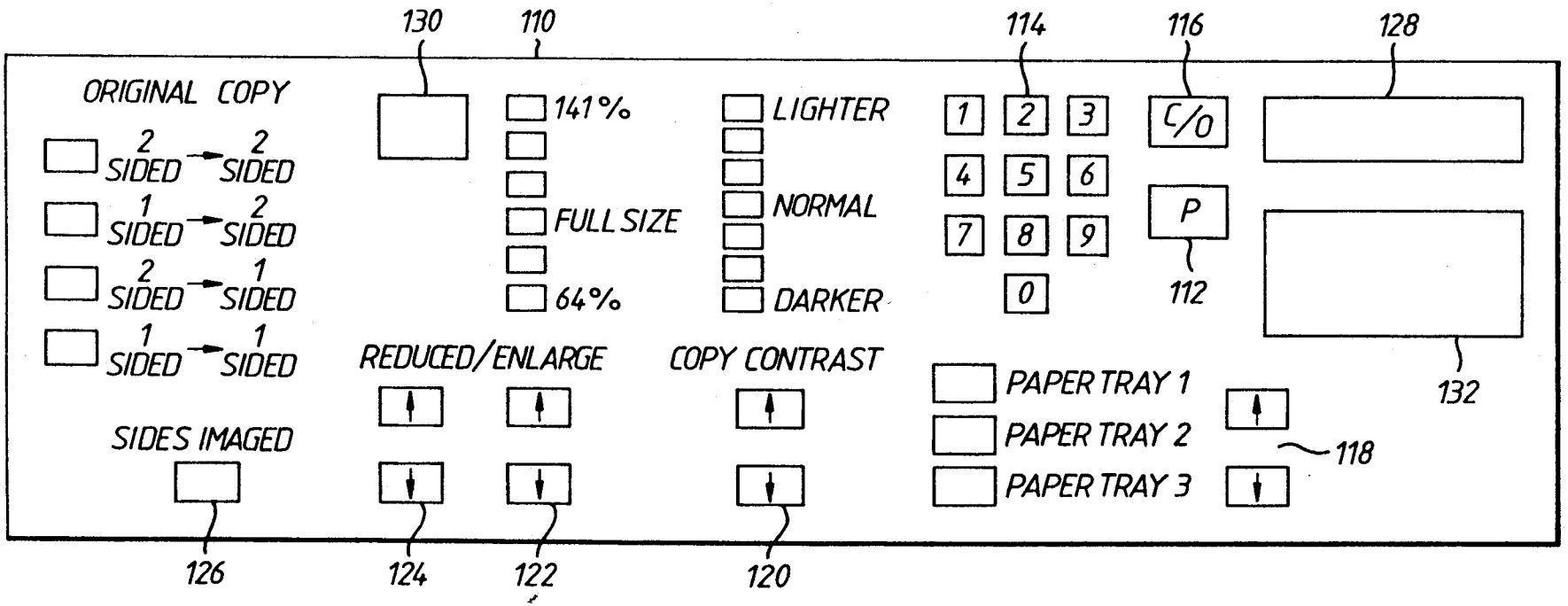
FIG. 2 is a plan view of an operation panel of the image forming apparatus shown in FIG. 1.

As shown in FIG. 2, copying machine 10 includes an operation panel 110 provided on the front portion of the upper surface of housing 12. Operation panel 110 includes copy key 112 for starting the copying operation, ten keys 114 for entering the number of copies, a clear/-stop key 116 for clearing the number of copies designated and for stopping a copying operation, a first select key 118 for selecting one of paper supply cassettes 60*a*, 60*b* and 60*c*, a copy contrast key 120 for designating image contrast of a copy in, for example 7 steps, a scale factor key 122 for setting copy scale factors for reduced or enlarged scale in predetermined relations and a zoom key 124 for adjusting the copy scale factor in a user-determined variable manner. Operation panel 110 also includes a second select key 126 for selecting the sides-to-be-copied. In the illustrated embodiment, an operator can select four variations by second select key 126, for example, double-sided (original) to double-sided (copy); single-sided (original) to double-sided (copy); double-sided (original) to single-sided (copy); and single-sided (original) to single-sided (copy).

Operation panel 110 further includes a first display 128 for displaying, for example, the number of copies selected by keys 114, a second display section 130 for displaying the copy scale factor set by zoom key 114 and a third display section 132 for displaying a plurality of information with respect to the copying operation.

Figure 3:
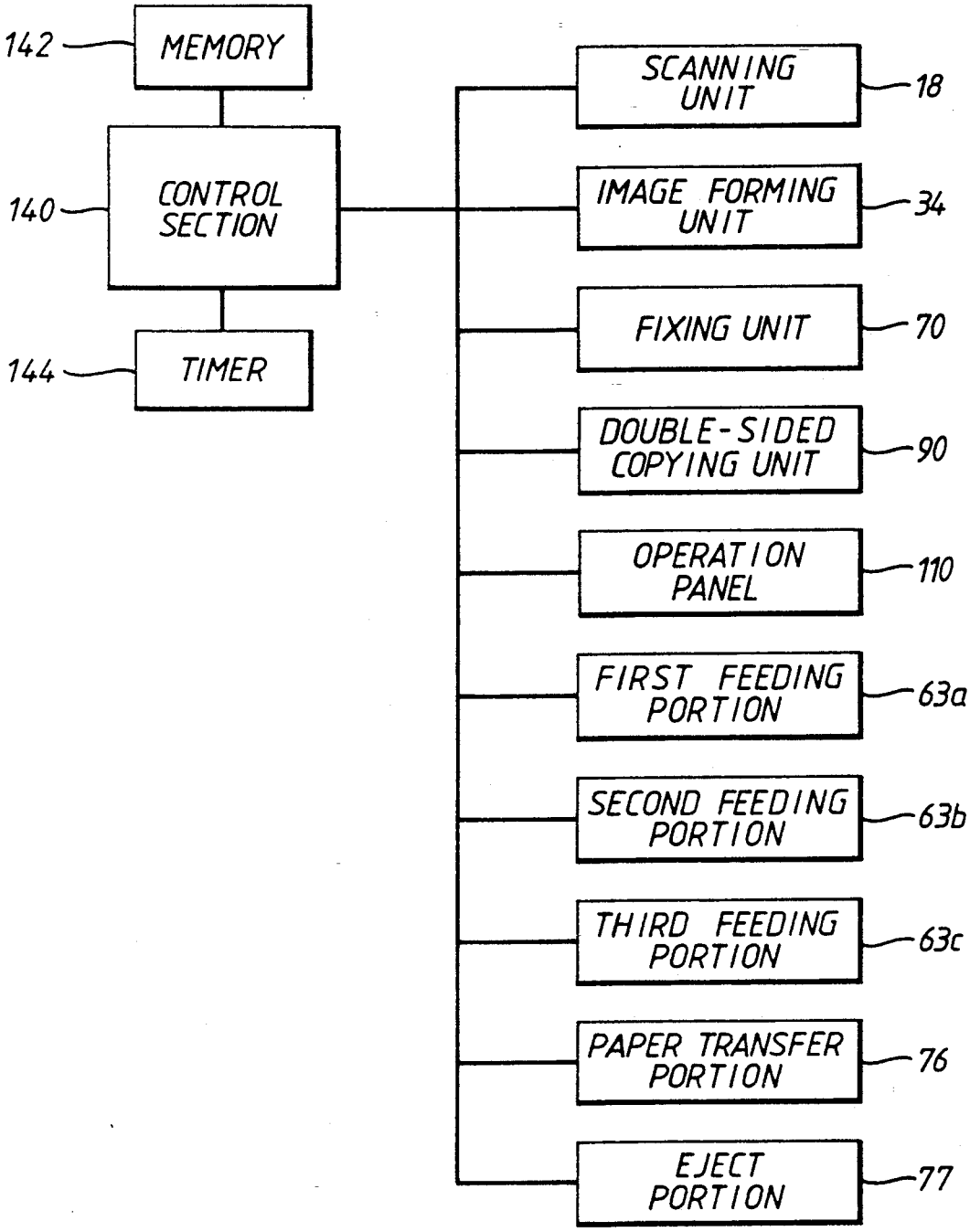
FIG. 3 is a block diagram showing an arrangement of a controller of the image forming apparatus shown in FIG. 1.

FIG. 3 shows an arrangement of a main part of a controller of copying machine 10. Referring to FIG. 3, copying machine 10 includes a control section 140 for performing overall control of copying machine 10 and a memory 142 for storing a control program. Control section 140 is operated in accordance with the control program stored in memory 142. Control section 140 is coupled to, for example, scanning unit 18, image forming unit 34, first, second and third feeding portion 63*a*, 63*b* and 63*c*, fixing unit 70, paper transport portion 76, eject portion 77, double-sided copying unit 90 and operation panel 111 for performing control of the copying operations of copying machine 10.

Control section 140 is also coupled to a timer 144 for initiating time measurement to measure a prescribed time after the image forming operation has completed or the prescribed copying modes have been set by operation panel 110. Thereby, control section 140 may revert to an initial copying mode setting if copying machine 10 does not operate for a predetermined time, for example, about 45 seconds, while the a selected copying mode is set by operation panel 110.

A double-sided copying operation of copying machine 10 will now be described with reference to FIGS. 1 to 3.

An operator places an original document on document table 14 and designates the double-sided copying mode of operation by depressing second select key 126 and by selecting the number copies desired by depressing one or more of keys 114. Also, the operator selects one of the paper supply cassettes 60*a*, 60*b* or 60*c* by depressing first select key 118. Thereafter, the operator depresses copy key 112. In response, control section 140 controls scanning unit 18 and image forming unit 34 to form an image corresponding to the original document on photosensitive drum 32. At the same time, control section 140 controls feeding portion 63*a*, 63*b* or 63*c* to pick up paper sheet P from cassette 60*a*, 60*b* or 60*c* and supply paper sheet P to the image transfer position. Thereby, the image of the original document placed on document table 14 is formed on the first side of paper sheet P.

Next, control section 140 controls paper transport portion 76 and fixing portion 70 to fix the image formed on the first side of paper sheet P. After the image is fixed on the first side of paper sheet P, paper sheet P is transported to double-sided copying unit 90 and stacked in stacking portion 92.

For example, when the operator designates single-sided (original) to double-sided (copy) by second select key 126, and selects five copies by keys 114, the above copying operation repeats five times. Thereby, five paper sheets P having the image are stacked in stacking portion 92.

After the copying operation for the image on the first side of paper sheets P is completed, the operator places another original document on document table 14 and depresses copy key 112. In response, control section 140 controls scanning unit 18 and image forming unit 34 to form an image corresponding to the second original on photosensitive drum 32. At the same time, control section 140 controls double-sided copy unit 90 to pick up paper sheets P from stacking portion 92 and supply paper sheet P to the image transfer position again. As described above, pickup rollers 94 of double-sided copying unit 90 pick up paper sheets P stacked in stacking portion 92 from the direction opposite from that in which they were initially stacked in stacking portion 92. Paper sheets P are turned from the first side to the second side when arriving at the image transfer position. Thereby, the image of the second original document placed on document table 14 is formed on the second side of paper sheets P.

Next, control section 140 controls paper transport portion 76 and fixing portion 70 to fix the image formed on the second side of paper sheet P. After the image is fixed on the second side of paper sheet P, paper sheet P is ejected to output tray 62.

In this case, the above copying operation repeats 5 times and 5 paper sheets P on which the image is formed are ejected to output tray 62. Thereby, the copying operation for forming the image on the first and second sides of paper sheets P is completed.

Figure 4A:
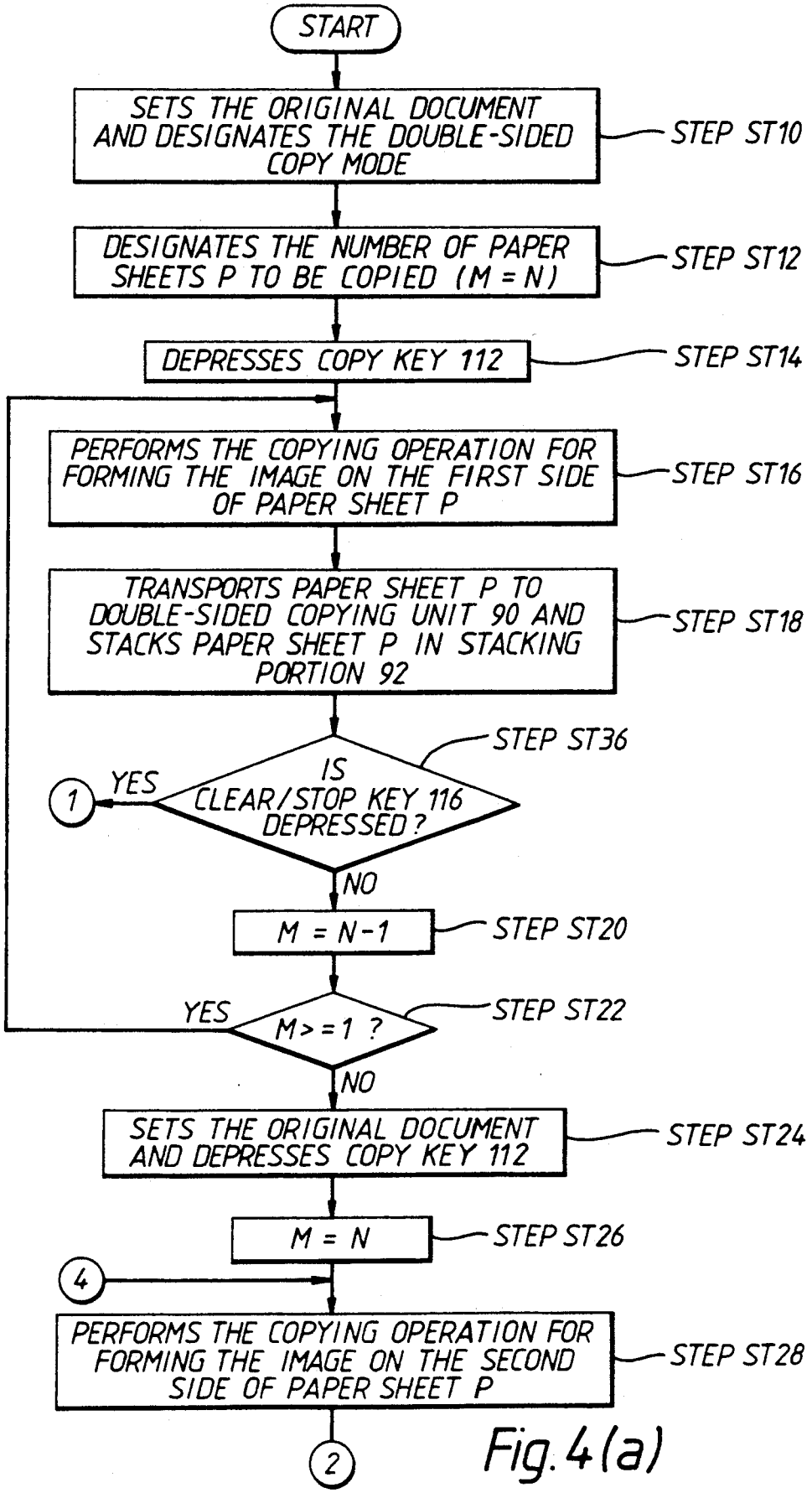
FIGS. 4(*a*) to 4(*c*) are flow charts showing an operation of the image forming apparatus shown in FIG. 1.
Figure 4B:
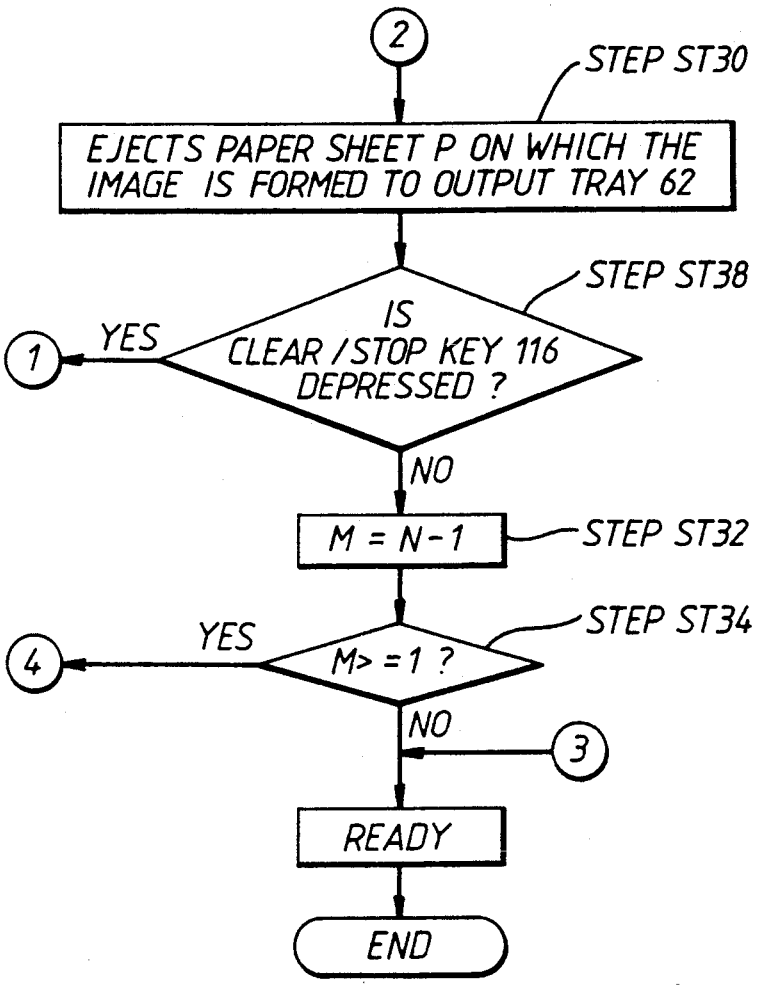
Figure 4C:
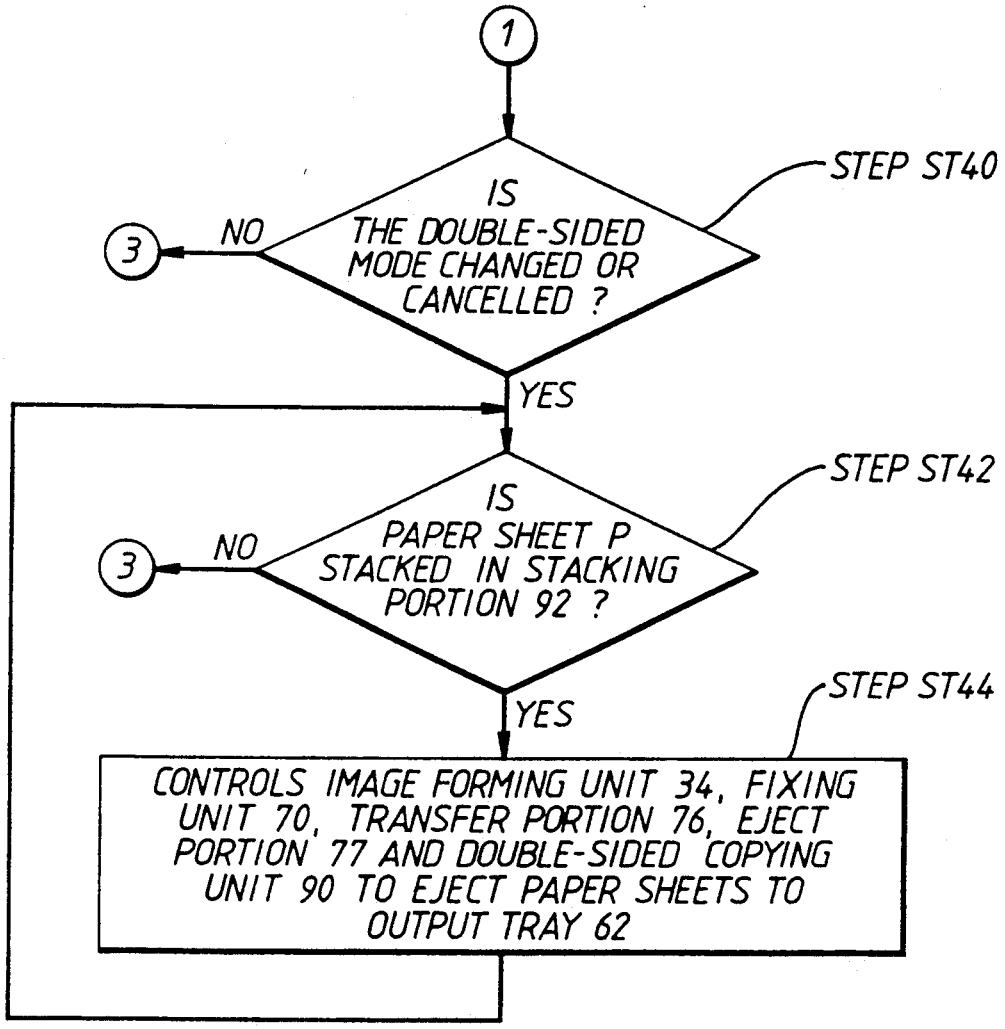

Referring to FIGS. 4(*a*) to 4(*c*), an operation of copying machine 10 will be described when the double-sided copy mode is changed or cancelled.

As described above, for example, initially the operator sets a first original document on document table 14 and designates the double-sided copy mode by second select key 126, (step ST10). The operator also designates the number of paper sheets P to be copied by keys 114 (step ST12) and depresses copy key 112 (step ST14). In response, copying machine 10 performs the copying operation for forming the image of the first original document on the first side of paper sheet P (step ST16). After that, paper sheet P on which the image is formed is transported to double-sided copying unit 90 and is stacked in stacking portion 92 (step ST18). The above copying operation repeats the prescribed number of times designated by ten keys 114 (steps ST20 and ST22).

Next, the operator sets a second original document on document table 14 and depresses copy key 112 (step ST24). In response, copying machine 10 performs the copying operation for forming the image of the second original document on the second side of paper sheet P (steps ST26 and ST28). Paper sheet P on which this second image is formed is ejected to output tray 62 (step ST30). The copying operation repeats the prescribed number of times designated by ten keys 114 (steps ST32 and ST34).

In this example, if the operator cancels or changes the double-sided copy mode while copying machine 10 is performing the copying operation, control section 140 of copying machine 10 controls image forming unit 34, fixing unit 70, paper portion 76, eject portion 77 and double-sided copying unit 90 to eject paper sheets P stacked in stacking portion 92 to output tray 62. That is, if the operator depresses clear/stop key 116 to interrupt the copying operation while copying machine 10 is performing the copying operation (step ST36 or step ST38), and when the double-sided copy mode is changed or cancelled by the operator (step ST40), control section 140 detects the presence of paper sheets P stacked in stacking portion 92 by first sensor 100 (step ST42). When first sensor 100 detects paper sheets P stacked in stacking portion 92, control section 140 operates image forming unit 34, fixing unit 70, paper portion 76, eject portion 77 and double-sided copying unit 90 to eject the paper sheets P stacked in stacking portion 92 to output tray 62 (step ST44).

Control section 140 drives pick up rollers 94 to pick up paper sheets P stacked in stacking portion 92 and drives first and second supply rollers 96 and 98 and aligning rollers 66 to supply paper sheet P to the image transfer position. Control section 140 also controls scanning unit 18 and image forming unit 34. When paper sheet P stacked in stacking portion 92 is supplied to the image transfer position, control section 90 operates photosensitive drum 32, developing unit 38 and cleaning unit 42. However, control section 140 does not operate scanning unit 18, and charging unit 36 and image transfer unit 40 to perform a blanked copying operation.

Control section 140 also operates paper transport portion 76, fixing unit 70 and eject portion 77 to feed paper sheet P supplied to the image transfer position. Control section 140 also drives gate 82 to supply paper sheet P to output tray 62. As a result, paper sheets P stacked in stacking portion 92 are ejected to output tray 62 when the double-sided copy mode is changed or cancelled by the operator.

Control section 140 will repeat this paper sheet eject operation until stacking portion 92 has no paper sheet P remaining.

In the present invention, copying machine 10 can automatically eject paper sheets P stacked in stacking portion 92 of double-sided copying unit 90 to output tray 62 when the double-sided copy mode is changed or cancelled by the operator. Therefore, it is not necessary to open the front cover to remove the paper sheets from stacking portion 92 of double-sided copying unit 90. Further, it is not necessary to form a blank image on paper sheets P to remove paper sheets P from stacking portion P. Thus, in copying machine 10 of the present invention, paper sheets P stacked in stacking portion 92 when the double-sided copy mode is changed or cancelled by the operator are automatically and conveniently removed.

Figure 5A:
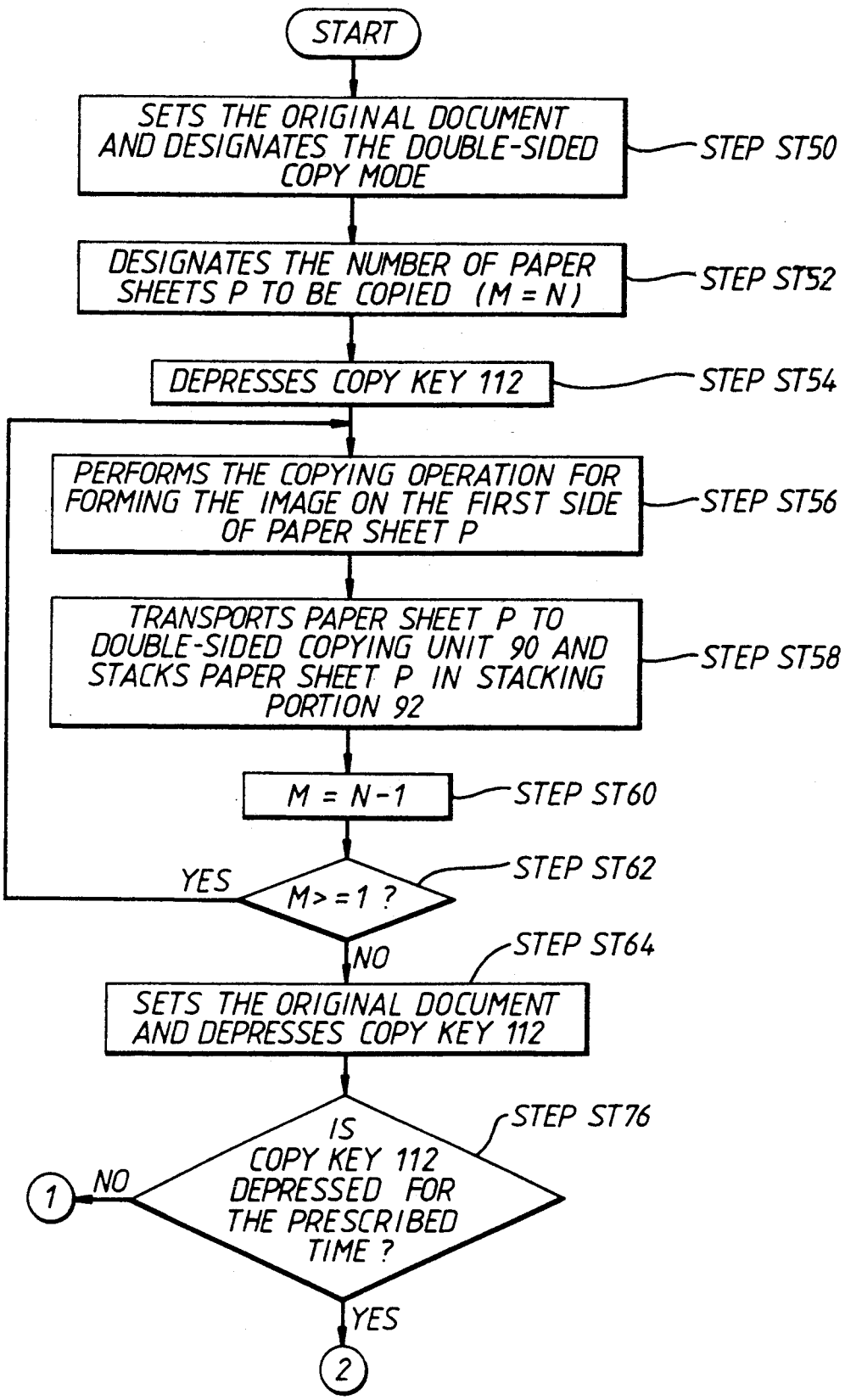
FIGS. 5(*a*) to 5(*c*) are flow charts showing another operation of the image forming apparatus shown in FIG. 1.
Figure 5B:
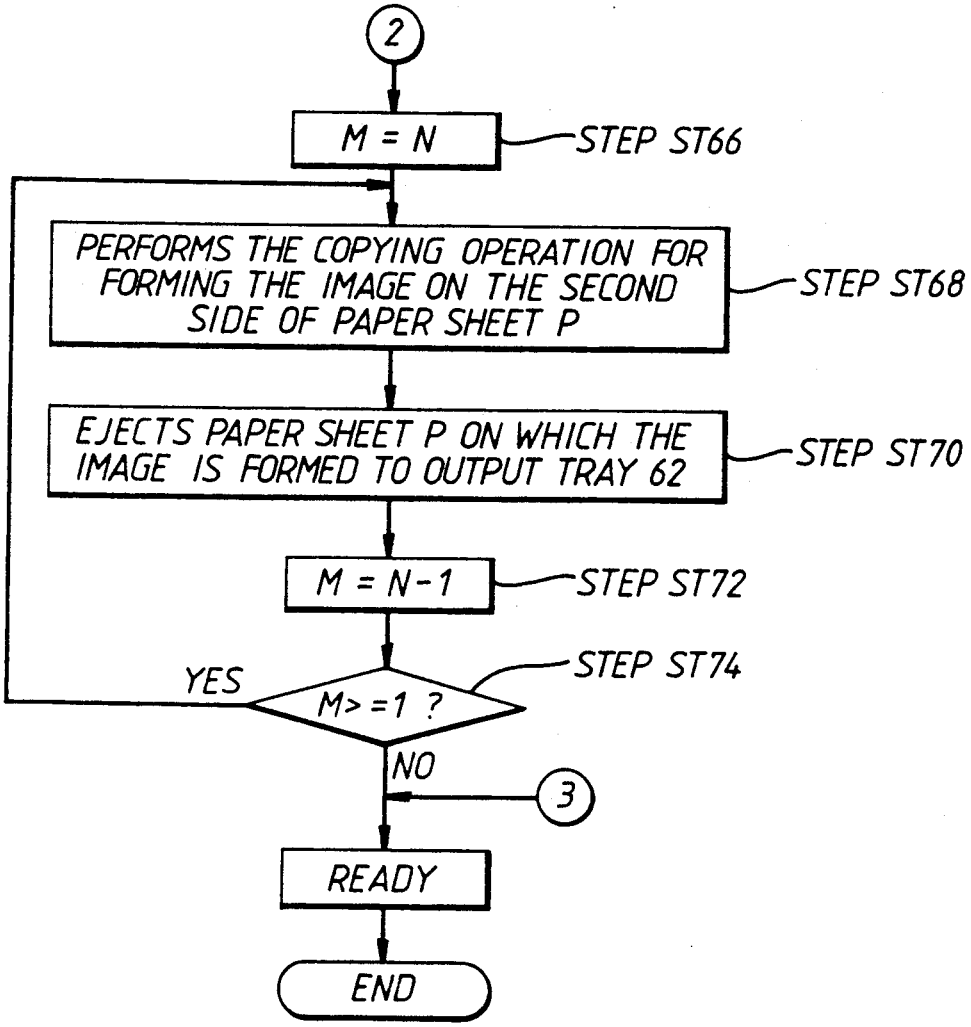
Figure 5C:
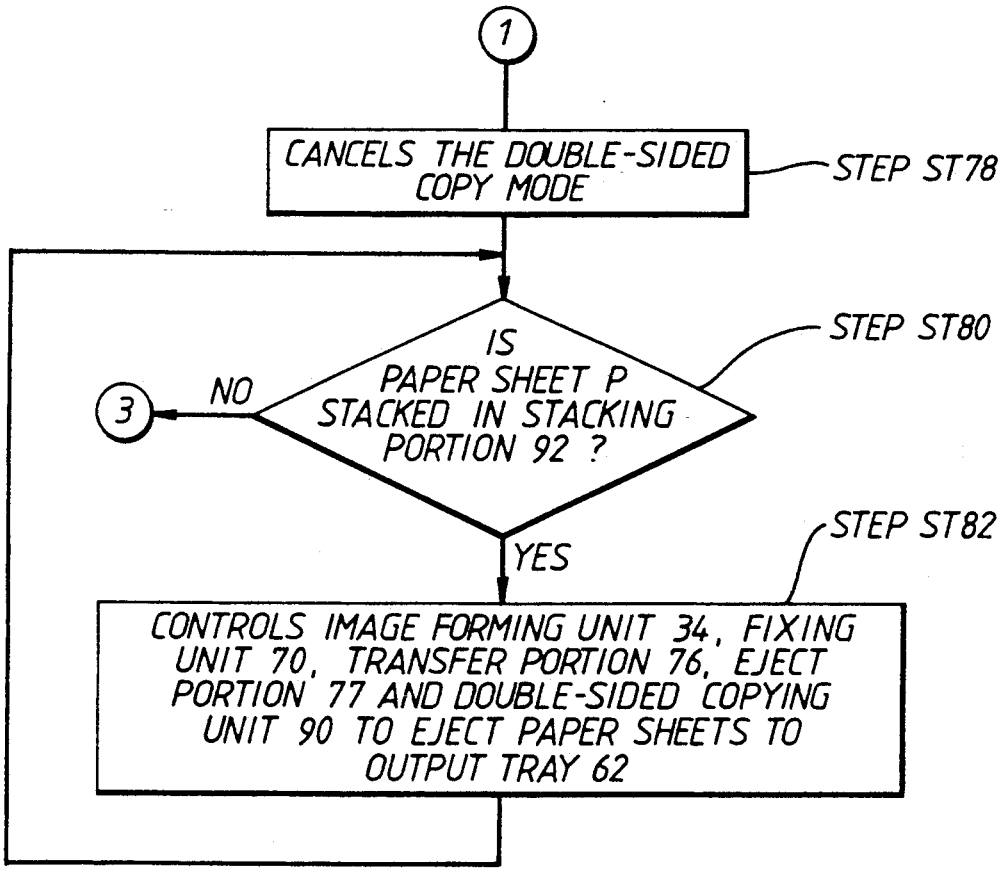

Referring to FIGS. 5(*a*) to 5(*c*), another operation for ejecting paper sheets P stacked in stacking portion 92 of double-sided copying unit 90 will be described.

Similar to the above operation, for example, initially the operator sets a first original document on document table 14 and designates the double-sided copy mode by second select key 126 (step ST50). Also, the operator designates the number of paper sheets P to be copied by keys 114 (step ST52) and depresses copy key 112 (step ST54). In response, copying machine 10 performs the copying operation for forming the image of the first original document on the first side of paper sheet P (step ST56). After that, paper sheet P on which the image is formed is transported to double-sided copying unit 90 and is stacked in stacking portion 92 (step ST58). The above copying operation repeats the prescribed number of times designated by ten keys 114 (steps ST60 and ST62).

Next, the operator sets a second original document on document table 14 and depresses copy key 112 (step ST64). In response, copying machine 10 performs the copying operation for forming the image of the second original document on the second side of paper sheet P (steps ST66 and ST68). Paper sheet P on which the second image is formed is ejected to output tray 62 (step ST70). This copying operation repeats the prescribed number of times designated by keys 114 (steps ST72 and ST74).

In the present invention, copying machine 10 includes timer 144 for initiating time measurement at a prescribed time after the image forming operation has completed, or after the prescribed copy mode has been set operation panel 110. Thereby, control section 140 can revert to a normal copy mode if copying machine 10 does not operate for a predetermined time, for example, about 45 seconds, while a prescribed copy mode is set by operation panel 110.

For example, if an operator does not depress copy key 112 in step ST64 for the prescribed time, for example, about 45 seconds, after the copying operation has completed, control section 140 cancels the double-sided copy mode. At the same time, control section 140 also controls image forming unit 34, fixing unit 70, paper transport portion 76, eject portion 77 and double-sided copying unit 90 to automatically eject paper sheets P stacked in stacking portion 92 to output tray 62.

If the operator does not depress copy key 112 for about 45 seconds after the copying operation has completed (step ST76), control section 140 cancels the double-sided copy mode (step ST78) and detects the presence of paper sheets P stacked in stacking portion 92 by first sensor 100 (step ST80). If paper sheets P are stacked in stacking portion 92, control section 140 operates image forming unit 34, fixing unit 70, paper transport portion 76, eject portion 77 and double-sided copying unit 90 to eject paper sheets P stacked in stacking portion 92 to output tray 62 (step ST82).

Paper sheets P stacked in stacking portion 92 are picked up by pick up rollers 94 and are fed by first and second supply rollers 96 and 98 and aligning rollers 66 to the image transfer position. Photosensitive drum 32, developing unit 38 and cleaning unit 42 are operated by control section 140 when paper sheets P stacked in stacking portion 92 are supplied to the image transfer position. However, scanning unit 18, charging unit 36 and image transfer unit 40 are not operated by control section 140. Paper transport portion 76, fixing unit 70 and eject portion 77 are also operated by control section 140, to supply paper sheet P to output tray 62. As a result, paper sheet P stacked in stacking portion 92 are ejected to output tray 82 when control section 140 cancels the double-sided copy mode.

Control section 140 repeats this paper sheet eject operation until stacking portion 92 has no paper sheets P remaining. Thereby, copying machine 10 can automatically eject paper sheets P stacking in stacking portion 92 of double-sided copying unit 90 to output tray 62 when control section 140 cancels the double-sided copy mode.

In the embodiment described above, the kind of apparatus to which the present invention is applicable is not limited to an electrophotographic copying machine, but include any image forming apparatus known in the art, for example, a laser printer.

It should be understood that the detailed description and example, which indicates presently preferred embodiments of this invention, are given by way of illustration only. Various modifications and changes may be made to the present invention, without departing from the scope or spirit of the invention, as set forth in the following claims.

I claim:

1. An image forming apparatus comprising:

forming means for forming an image on a recording medium, the medium having a first and a second side;

mode setting means for setting at least a double-sided image forming mode, wherein said double-sided image forming mode controls said forming means to form the image on said first and second sides of said recording medium;

feeding means for providing said recording medium to said forming means to form the image on said second side of said recording medium when said double-sided image forming mode is set by said mode setting means said feeding means having stacking means for temporarily stacking said recording medium;

tray means for receiving said recording medium provided to said forming means by said feeding means; and control means for automatically ejecting said recording medium to said tray means when said recording medium is temporarily stacked in said stacking means and said double-sided image forming mode is changed by said mode setting means.

2. An image forming apparatus according to claim 1, wherein said control means includes operating means for operating said feeding means to eject said recording medium stacked in said stacking means to said tray means when said double-side image forming mode is changed.

3. An image forming apparatus according to claim 2 further comprising supporting means for positioning an original document; and scanning means for scanning an image of the original document positioned on the supporting means and providing the scanned image to the forming means.

4. An image forming apparatus according to claim 3, wherein said forming means comprises:

exposure means for forming a latent image on an image bearing member, the latent image corresponding to the image on the original document scanned by said scanning means;

developing means for developing the latent image formed on said image bearing member; and transfer means for transferring the image developed by said developing means onto said recording medium.

5. An image forming apparatus according to claim 4, wherein said control means includes means for preventing the operation of said scanning means, said exposure means and said transfer means for forming the image on said second side of said recording medium ejected automatically from said stacking means.

6. An image forming apparatus according to claim 1, wherein said stacking means includes detecting means for detecting the presence of said recording medium stacked therein.

7. An image forming apparatus according to claim 1, wherein said feeding means includes means for picking up said recording medium temporarily stacked in said stacking means for providing the recording medium to the forming means.

8. An image forming apparatus according to claim 1, further comprising timer means for determining a predetermined period of time after the image has been formed by said forming means or after said double-sided mode has been set by said setting means; and cancel means, coupled to said setting means, for cancelling said double-sided mode in response to said timer means.

9. An image forming apparatus comprising:

forming means for forming an image on a recording medium, said recording medium having a first side and a second side;

setting means for setting a forming operation mode of said forming means, said forming operation mode including at least a single-sided mode and a double-sided mode, wherein said single-sided mode is for forming an image on said first side of said recording medium and said double-sided mode is for forming an image on said first and second sides of said recording medium;

supply means for providing a supply of said recording medium;

first feeding means for feeding said recording medium from said supply means to said forming means for forming the image on said first side of said recording medium;

second feeding means for feeding said recording medium to said forming means for forming the image on said second side of said recording medium when said double-sided mode is set by said setting means, said second feeding means having stacking means for temporarily stacking said recording medium;

tray means for receiving said recording medium on which at least one image has been formed;

third feeding means for feeding said recording medium on which the at least one image is formed to said tray means; and control means for automatically ejecting said recording medium temporarily stacked in said stacking means to said tray means through said second feeding means and said third feeding means, when said forming operation mode is changed from said double-sided mode to said single-sided mode by said setting means.

10. An image forming apparatus according to claim 9, wherein said control means includes means for operating said second and third feeding means and said forming means to eject said recording medium stacked in said stacking means to said tray means.

11. An image forming apparatus according to claim 10 further comprising supporting means for positioning an original document; and scanning means for scanning an image on the original document positioned on said supporting means.

12. An image forming apparatus according to claim 11, wherein said forming means comprises:

exposure means for forming a latent image on an image bearing member, the latent image corresponding to the image on the original document scanned by said scanning means;

developing means for developing the latent image formed on said image bearing member; and transfer means for transferring the image developed by said developing means onto said recording medium.

13. An image forming apparatus according to claim 12, wherein said operating means includes means for preventing the operation of said scanning means, said exposure means and said transfer means from forming the image on said second side of said recording medium ejected automatically from said stacking means.

14. An image forming apparatus according to claim 9, wherein said stacking means includes detecting means for detecting the presence of said recording medium stacked therein.

15. An image forming apparatus according to claim 9 further comprising timer means for determining a predetermined period of time after the image has been formed by said forming means or after said double-sided mode has been set by said setting means; and changing means, coupled to said setting means, for changing said double-sided mode to said single-sided mode in response to said timer means.

16. A copying machine comprising:

supporting means for positioning an original document;

scanning means for scanning an image on the original document positioned on said support means;

forming means for forming an image on a recording medium having a first side and a second side, the formed image corresponding to the image on the original document scanned by said scanning means;

setting means for setting at least a double-sided operation mode of the forming means, wherein said double-sided operation mode is for forming the formed image on said first and second sides of said recording medium;

feeding means for feeding said recording medium to said forming means to form the formed image on said second side of said recording medium when said double-sided operation mode is set, said feeding means having stacking means for temporarily stacking said recording medium;

tray means for receiving said recording medium having the formed image;

first control means for automatically ejecting said recording medium temporarily stacked in said stacking means to said tray means when said double-sided operation mode is changed; and second control means for controlling said scanning means and said forming means to prevent forming an image on said second side of said recording medium ejected automatically from said stacking means by said first control means.

17. A copying machine according to claim 16, wherein said forming means comprises:

exposure means for forming a latent image on an image bearing member corresponding to the image on the original document scanned by said scanning means; and transfer means for transferring the latent image onto said recording medium.

18. A copy machine according to claim 17, wherein said second control means having first operating means for driving said image bearing member, and second operating means for preventing the operation of said scanning means, said exposure means and said transfer means, from forming the formed image on said second side of said recording medium ejected automatically from said stacking means.

19. A method for removing recording medium from an image forming apparatus, the recording medium having a first side and a second side, the image apparatus including an image copying device having a first operational mode for forming an image on the first side and the second side of the recording medium, an operational mode selection device coupled to the image copying device for selecting an operational mode a stacking device for temporarily stacking the recording medium when the first operational mode is selected and a receptacle for receiving recording medium having an image formed by the image copying device, the method comprising the steps of:

sensing an operational mode selected by the selection device;

routing recording medium to the stacking device after the image copying device has formed an image on the first side of the recording medium if the first operational mode has been selected;

sensing an operational mode selected by the selection device;

routing the recording medium from the stacking device to the image copying device to form an image on the second side of the recording medium if the first operational mode has not been changed while the recording medium is stacked in the stacking device, and routing the recording medium from the stacking device to the receptacle if the first operational mode has been changed while the recording medium is stacked in the stacking device.

20. The method according to claim 19 further comprising the step of routing the recording medium through the image copying device if the first operational mode has been changed while the recording medium is stacked in the stacking device.

21. The method according to claim 20 further comprising the step of performing a blank image forming operation when the recording medium is routed through the image copying if the first operational mode has been changed while the recording medium is stacked in the stacking device.

22. The method according to claim 19 further comprising the step of selecting a default operational mode of the image copying device if a first predetermined period of time elapses after the first operational mode has been selected.

23. The method according to claim 19 further comprising the step of selecting a default operational mode of the image copying device if a second predetermined period of time elapses after the recording medium has been stacked in the stacking device.

24. The method according to claim 19 further comprising the step of sensing whether recording medium is stacked in the stacking device if the first operational mode has been changed.

25. An image forming apparatus comprising:

forming means for forming an image on a recording medium, the medium having a first side and a second side;

mode setting means for setting at least a double-sided image forming mode, wherein said double-sided image forming mode controls said forming means to form the image on said first and second sides of said recording medium;

feeding means for providing said recording medium to said forming means to form the image on said second side of said recording medium when said double-sided image forming mode is set by said mode setting means, said feeding means having stacking means for temporarily stacking said recording medium;

tray means for receiving said recording medium provided to said forming means by said feeding means;

timer means for determining a predetermined period of time after the image has been formed by said forming means or after said double-sided mode has been set by said setting means;

cancel means for cancelling said double-sided mode in response to said timer means; and control means for automatically ejecting said recording medium to said tray means when said recording medium is temporarily stacked in said stacking means in response to said cancel means.

26. An image forming apparatus comprising:

forming means for forming an image on a recording medium, the medium having a first and a second sides;

setting means for setting a forming operation mode of said forming means, said forming operation mode including at least a single sided mode and a double-sided mode, wherein said single-sided mode is for forming an image on said first side of said recording medium and said double-sided mode is for forming an image on said first and second side of said recording medium;

supply means for providing a supply of said recording medium;

first feeding means for feeding said recording medium from said supply means to said forming means for forming the image on said first side of said recording medium;

second feeding means for feeding said recording medium to said forming means for forming the image on said second side of said recording medium when said double-sided mode is set by said setting means, said second feeding means having stacking means for temporarily stacking said recording medium;

tray means for receiving said recording medium provided to said forming means by said first and second feeding means;

timer means for determining a predetermined period of time after the image has been formed by said forming means or after said double-sided mode has been set by said setting means;

changing means for changing said double-sided mode to said single-sided mode in response to said timer means; and control means for automatically ejecting said recording medium to said tray means when said recording medium is temporarily stacked in said stacking means in response to said changing means.

27. A copying machine comprising:

supporting means for positioning on an original document;

scanning means for scanning an image on the original document positioned on said support means;

forming means for forming an image on a recording medium having a first side and a second side, the formed image corresponding to the image on the original document scanned by said scanning means;

setting means for setting at least a double-sided operation mode of the forming means, wherein said double-sided operation mode is for forming the formed image on said first and second sides of said recording medium;

feeding means for feeding said recording medium to said forming means to form the formed image on said second side of said recording medium when said double-sided operation mode is set, said second feeding means having stacking means for temporarily stacking said recording medium;

tray means for receiving said recording medium having the formed image;

timer means for determining a predetermined period of time after the image has been formed by said forming means or after said double-sided mode has been set by said setting means;

cancel means for cancelling said double-sided mode in response to said timer means;

first control means for automatically ejecting said recording medium temporarily stacked in said stacking means to said tray means in response to said cancel means; and second control means for controlling said scanning means and said forming means to prevent forming an image on said second side of said recording medium ejected automatically from said stacking means by said first control means.

* * * * *